United States Patent [19]

Crnojevich et al.

[11] 4,149,875

[45] Apr. 17, 1979

[54] PURIFICATION OF NICKEL AND COBALT METAL POWDERS BY A CAUSTIC WASH

[75] Inventors: Ranko Crnojevich, Gretna; Edward I. Wiewiorowski; Luther R. Tinnin, both of New Orleans, all of La.

[73] Assignee: AMAX Inc., Greenwich, Conn.

[21] Appl. No.: 883,379

[22] Filed: Mar. 6, 1978

[51] Int. Cl.[2] ..... C22B 23/00

[52] U.S. Cl. ..... 75/0.5 A; 75/0.5 AA; 75/108; 75/109; 75/119; 252/477 Q

[58] Field of Search ..... 75/0.5 A, 0.5 AA, 108, 75/109, 119; 252/477 Q

[56] References Cited

U.S. PATENT DOCUMENTS

| | | | |
|---|---|---|---|
| 2,257,800 | 10/1941 | Howk | 252/477 Q |
| 2,388,959 | 11/1945 | Drew | 252/477 Q |
| 2,583,619 | 1/1952 | White | 252/477 Q |
| 2,753,257 | 7/1956 | Nashner et al. | 75/108 |

*Primary Examiner*—G. Ozaki

*Attorney, Agent, or Firm*—Michael A. Ciomek; Eugene J. Kalil

[57] ABSTRACT

A method is provided for decreasing the silicon content of relatively pure nickel and/or cobalt powder, wherein silicon is present as an impurity substantially in the oxidic state. The method comprises mixing the metal powder in an aqueous solution of an alkali metal hydroxide, e.g. sodium hydroxide, with the temperature of the solution ranging from ambient to below boiling and maintaining the powder in contact with the solution until the silicon content of the powder has been reduced to the desired level.

9 Claims, No Drawings

PURIFICATION OF NICKEL AND COBALT METAL POWDERS BY A CAUSTIC WASH

This invention relates to a method of reducing the residual silicon content of relatively high purity metal powder selected from the group consisting of nickel and cobalt and, in particular, to a method of reducing the residual silicon content and at least one other metal impurity in said relatively high purity metal powder powder produced by the hydrogen reduction of aqueous solutions of said nickel and/or cobalt.

BACKGROUND OF THE INVENTION

Nickel and cobalt metal powders of high purity are generally produced by three techniques: (1) the carbonyl method based on the decomposition of nickel carbonyl gas under controlled conditions; (2) by the electrolytic method using a nickel or cobalt anode; and (3) by the hydrogen reduction of the metal from aqueous solutions thereof.

The carbonyl (CPM) and the electrolytically (ELM) produced metal powders tend to be more superior in high purity than the hydrogen reduced powders (HPM). The ASTM specification for nickel powder is compared below with some samples of ELM, CPM and HPM powders.

| | | Elements, ppm | | | | | | | | | | | |
|---|---|---|---|---|---|---|---|---|---|---|---|---|---|
| | | S | C | O | Fe | Cu | Pb | As | Sb | Se | Si | Ca | Co |
| | ASTM Spec. | 100 | — 300 | NE** | 200 | 200 | 50 | 50 | 50 | NE** | 50 | NE** | 1500 |
| PRO- | ELM | 5 | ~ 50 | 100 | 20 | 20 | <10 | <10 | <10 | <5 | <10 | <15 | <200 |
| DUCT | CPM | ~ 5 | <1000 | 100 | 15 | 10 | <10 | <10 | <10 | — | ~ 10 | <15 | <100 |
| | HPM | <50 | 100 | 300 | 50 | 20 | <10 | <10 | <10 | ≲20 | <100 | <15 | <1000 |

**NE = Non-existent

The three commercial powders may vary in specification from producer to producer and may also vary according to a particular production run. This is especially the case in the production of the HPM product.

The HPM powder product, as stated earlier, is produced by the hydrogen reduction of nickel and cobalt from solutions. Such solutions as generally obtained by high pressure leaching of nickel lateritic ores or nickel mattes in sulfuric acid or ammoniacal solutions. The ores or mattes generally contain impurities (e.g. Si, Fe, Al, Cr, among others) which carry over into the leaching circuit.

Hydrometallurgical schemes for producing a high purity nickel (cobalt) powder are normally quite complex. An overall objective is to generate the purest possible streams of these metals before the final step of recovering these elements in the metallic form. The impurity content of trace elements in these streams should be below 1000 ppm for difficult to reduce elements like Ca, Mg, Zn; below 50 ppm for the elements which tend to coprecipitate with metals, such as Si, Fe, Al, Cr, As, Sb and less than 2 ppm for elements which tend to reduce to metallics as easily as nickel, for example, Cu, Pb and Se.

Methods for producing HPM nickel or cobalt powders of the foregoing type are disclosed in U.S. Pat. Nos. 2,753,257, 2,767,081, 2,767,082 and 2,767,083.

In a commercial operation, it is difficult to maintain the desired criteria as to high purity. Changes in compositions of the feeds, loss in a process control, external contamination (environmental dust, need to recover plant spillages, etc.), may more or less cause intolerable contamination of the final product. That is particularly the case with silicon.

An impurity level of a few parts per million and especially in the tens of ppm by weight (10 ppm=0.001%) can make the difference between salable and non-salable products, the latter generally leading to discounted price penalties which can lead to significant economic loss. This is particularly the case for silicon which is a common impurity in the production of hydrogen precipitated nickel or cobalt. For example, it should be noted that contamination of more than 0.5 parts Si per 10,000 parts by weight of metals is considered the limit allowable under the specification.

We have found that HPM produced powder can be significantly reduced in silicon content by treating the powder with a solution of an alkali metal hydroxide, such as a sodium hydroxide solution.

It is known in the preparation of Raney nickel to leach an alloy of nickel and silicon with sodium hydroxide in order to leach partially and selectively some of the contained silicon so as to produce a highly catalytic nickel at the surface of the alloy. The dissolution of the alloy is exothermic in that the sodium hydroxide reacts with silicon to form sodium silicate accompanied by evolution of heat.

One method of producing Raney nickel catalyst is disclosed in U.S. Pat. No. 2,583,619 which refers to a preferred alloy composition of 35 to 65% by weight of removable metal (e.g. silicon) and the balance nickel. The alloy surface is treated with an aqueous solution of sodium hydroxide (10% to 50% solution) at about 245° F. to 250° F. (118° C. to 121° C.) to remove selectively silicon and form a skeleton containing active nickel which is washed free of the treating solution with cold water.

The preparation of the Raney nickel catalyst is not the same as the present invention in that the nickel powder treated in the present invention is relatively pure and contains at least about 97% nickel plus cobalt, the silicon being generally present in the oxidic state as occluded silicates or as $SiO_2$ due to external contamination. Normally, it is a fine two-phase mixture of the silicon impurity in the metallic product.

OBJECTS OF THE INVENTION

It is an object of the invention to provide a method of decreasing the silicon content of relatively pure metal powder precipitated from aqueous solutions by hydrogen reduction.

Another object is to provide a method of decreasing the silicon content and at least one other impurity of a relatively pure nickel, cobalt or copper powder precipitated from aqueous solution by hydrogen reduction.

These and other objects will more clearly appear when taken in conjunction with the following disclosure and the appended claims.

STATEMENT OF THE INVENTION

One embodiment of the invention is directed to a method for decreasing the silicon content of a relatively pure metal powder selected from the group consisting of nickel and cobalt, said powder containing at least about 97% by weight of at least one of said metals, wherein said silicon is present as an impurity substantially in the oxidic state, the method comprising mixing said powder in an aqueous solution of an alkali metal hydroxide, with the temperature of the solution ranging from ambient to below boiling, and maintaining said powder in contact with said solution until the silicon content of said powder has been substantially reduced, for example, at least about 25% by weight of its initial content, with the aim of providing a final silicon content not exceeding about 50 ppm. The method is preferably applicable to the foregoing metal powders produced by the hydrogen reduction of an aqueous solution thereof.

It has been found that, by treating the HPM produced powder in a solution of sodium hydroxide, the silicon content of the powder can be significantly reduced and an "off grade" product brought in a substantial number of cases to within specification requirements with respect to at least the silicon content.

The caustic wash treatment can be carried out over a preferred range of NaOH concentrations of, for example, about 5 to 20% NaOH by weight. The method may be carried out at atmospheric pressure at temperatures below the boiling point, for example, in the range of 120° F. to 160° F. (49° C. to 71° C.). The time of treatment may depend on the silicon content and on the physical characteristics of the powder. Generally, the time does not exceed about five hours and is usually from about 0.5 to 2 hours. It is essential that the metal powder be intimately mixed (suspended) with NaOH solution during the treatment. The metal slurry pulp density can advantageously be about or above 50% by weight. The pulp density can range broadly from about 10% to 70%. In numerous tests, the treatment of the invention enabled the reduction in silicon content of various samples of up to about 70% to 80%, e.g. from a level of about $\gtrsim$200 ppm to a level of <40 ppm, and generally to a level in the range of about 10 to 30 ppm Si.

The invention is applicable to the reduction of silicon from relatively pure metals containing up to about 500 ppm and usually up to about 200 ppm silicon. The caustic treatment is generally applied to nickel and/or cobalt metal powders containing amounts of silicon in excess of 50 ppm. However, the invention is applicable to powders containing less than about 50 ppm silicon.

The most common relatively pure powders produced by hydrogen reduction from aqueous solutions are nickel and cobalt.

It should be noted that, in addition to silicon, other impurities soluble in caustic may be reduced, such as Fe, Al, Cr and Zn, among others. Thus, stated another way, the invention is directed to the reduction of silicon and at least one other impurity selected from the group consisting of Fe, Al, Cr, Zn and the like.

As illustrative of the detail aspects of the invention, the following examples are given.

EXAMPLE 1

Each of a number of nickel powder samples produced by hydrogen reduction obtained from refinery production runs was treated with 5% and 10% NaOH solutions, respectively, for 1 hour at 150° F. (65° C.) at a pulp density of 50% solids with the following results.

| | Untreated Powder | 5% NaOH Treatment | | 10% NaOH Treatment | |
|---|---|---|---|---|---|
| Samples | Si Content ppm | Final Si Content ppm | Silicon Reduced % | Final Si Content ppm | Silicon Reduced % |
| (1) | 56 | 22 | 61 | 10 | 82 |
| (2) | 56 | 30 | 46 | <10 | >84 |
| (3) | 117 | <10 | >92 | <10 | >92 |
| (4) | 250 | 68 | 73 | 54 | 78 |
| (5) | 92 | 57 | 38 | 31 | 65 |
| (6) | 73 | 14 | 81 | 14 | 81 |
| (7) | 162 | 10 | 94 | <10 | >94 |
| (8) | 40 | 22 | 45 | <10 | 75 |
| (9) | 163 | 14 | 91 | 16 | 90 |
| (10) | 46 | <10 | 88 | 14 | 70 |
| (11) | 61 | <10 | >84 | <10 | >84 |

While Samples (4) and (5) at 5% NaOH concentration showed a substantial reduction in silicon content in one hour of treatment, Sample (4) being reduced to 68 ppm at 73% reduction and Sample (5) to 57 ppm at 38% reduction, it will be appreciated that the residual silicon content can be further reduced by merely increasing the time of treatment to substantially above one hour and/or by increasing the NaOH concentration. Thus, at 10% NaOH concentration, Sample (4) was reduced to 54 ppm and Sample (5) to 31 ppm in one hour. Further treatment of Sample (4) in excess of one hour will reduce the residual silicon content to less than 50 ppm.

Thus, it is clearly apparent from the table that the treatment of the powders with alkali metal hydroxide (e.g. NaOH, KOH, etc.) is very effective in reducing the silicon content to below 50 ppm. The solution concentration may range from about 5% to 30% by weight of alkali metal hydroxide. Where the powder being treated contains relatively high amounts of silicon, e.g. in excess of 100 ppm, the concentration of the solution is preferably on the high side, such as from about 10% to 20% by weight or higher to reduce the silicon to a level not exceeding 50 ppm. In any event, the time of treatment at a particular alkali metal solution concentration should be sufficient to provide a final residual silicon of less than 50 ppm, particularly where the initial silicon content is substantially in excess of 50 ppm.

EXAMPLE 2

A 200 gram sample of hydrogen precipitated nickel powder (screen size: 100% between 200 and 325 mesh) was treated with a 5% solution of NaOH for 30 minutes at 160° F. (60° C.) at a pulp density of 50% solids. The nickel powder was filtered and washed with water. The assay of the powder before and after treatment is given as follows:

| | Si(ppm) | Se(ppm) | Al(ppm) | Cr(ppm) |
|---|---|---|---|---|
| Before | 46 | 32 | 4 | 4 |
| After | 10 | 26 | 1 | 2 |

A substantial reduction was effected in each of the impurities, the silicon being reduced about 78.26% by weight.

EXAMPLE 3

A 200 gram sample of hydrogen precipitated cobalt powder (screen size: +200 mesh—1.7%, +325 mesh—10%, minus 325 mesh—88.3%) was treated with 15% NaOH solution for 2 hours at 140° F. (60° C.) at a pulp density of 50% solids and thereafter filtered and washed with water. The assay of the cobalt before and after treatment was as follows:

| | Si(ppm) | Se(ppm) | Fe(ppm) | Cr(ppm) |
|---|---|---|---|---|
| Before | 23 | 18 | 160 | 220 |
| After | 12 | 15 | 105 | 100 |

As will be noted, each of the impurities was substantially reduced in content, the silicon content being reduced about 47.8% by weight.

EXAMPLE 4

A 200 gram sample of cobalt powder precipitated from an aqueous solution by hydrogen reduction (screen size: 98.4% minus 325 mesh) was treated with a 10% NaOH solution for 2 hours at 150° F. (65° C.) at a pulp density of 50% solids. The following results were obtained before and after treatment:

| | Si(ppm) | Zn(ppm) | Cr(ppm) |
|---|---|---|---|
| Before | 60 | 4 | 230 |
| After | 32 | 2 | 116 |

A substantial reduction in impurities was obtained, the silicon content being reduced about 46.6% by weight.

EXAMPLE 5

A 200 gram sample of metallic nickel powder (screen size U.S. Standard: +40 mesh—0%, +100—1.8%, +200 mesh—61.6%, +325 mesh—8.1% and minus 325 mesh—28.5% precipitated from an aqueous solution by hydrogen reduction was treated with a 10% by weight solution of NaOH for 3 hours at 140° F. (60° C.) at a pulp density of 50% solids. Following the treatment, the powder was washed with water. The assay of the nickel powder before and after treatment is given as follows:

| | Si(ppm) | Al(ppm) |
|---|---|---|
| Before | 250 | 28 |
| After | 54 | 6 |

As will be noted, the silicon content was reduced in content about 78.4% and the aluminum reduced about 78.4%.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A method for decreasing the silicon content of a relatively pure metal powder consisting essentially of at least about 97% by weight of at least one metal from the group consisting of nickel and cobalt, wherein said silicon is present as an impurity substantially in the oxidic state which comprises, mixing said powder in an aqueous solution of alkali metal hydroxide, with the temperature of the solution ranging from ambient to below boiling, and maintaining said powder in contact with said solution until the silicon content of said powder has been substantially reduced, with the final silicon content of said powder not exceeding about 50 ppm.

2. The method of claim 1, wherein said metal powder is produced by the hydrogen reduction of an aqueous solution containing said metal, wherein the amount of silicon in said metal powder ranges up to about 500 ppm and wherein the concentration of said solution ranges from about 5% to 30% by weight of said alkali metal hydroxide.

3. The method of claim 2, wherein said alkali metal hydroxide is sodium hydroxide.

4. A method for decreasing the silicon content of relatively pure metal powder consisting essentially of at least about 97% by weight of at least one metal selected from the group consisting of nickel and cobalt, said metal powder having been produced by hydrogen reduction from an aqueous solution thereof, and wherein said silicon is present as an impurity substantially in the oxidic state which comprises, mixing said powder containing up to about 500 ppm silicon in an aqueous solution of alkali metal hydroxide, with the temperature of the solution ranging from ambient to below boiling, the concentration of said solution ranging from about 5% to 30% by weight of said alkali metal hydroxide, and maintaining said powder in contact with said solution until the silicon content of said powder has been substantially reduced, with the final silicon content of said powder not exceeding about 50 ppm.

5. The method of claim 4, wherein the metal powder is nickel, and wherein the solution is a sodium hydroxide solution.

6. The method of claim 4, wherein the metal powder is cobalt, and wherein the solution is a sodium hydroxide solution.

7. A method of decreasing the silicon content of relatively pure metal powder consisting essentially of at least 97% by weight of at least one metal selected from the group consisting of said nickel and cobalt, produced by hydrogen reduction from an aqueous solution thereof, said powder also containing at least one other impurity selected from the group consisting of Fe, Al, Cr, Zn, and Se, said silicon being present in an amount ranging up to about 500 ppm, said silicon being present in said powder in substantially the oxidic state which comprises, mixing said powder in an aqueous solution of an alkali metal hydroxide of concentration ranging from about 5% to 30% with the temperature of the solution ranging from ambient to below boiling, and maintaining said powder in contact with said solution until the silicon content of said powder has been substantially reduced, with the final silicon content of said powder not exceeding about 50 ppm, while also reducing the content of said at least one other impurity.

8. The method of claim 7, wherein the metal powder is nickel and wherein the solution is a sodium hydroxide solution.

9. The method of claim 7, wherein the metal powder is cobalt and wherein the solution is a sodium hydroxide solution.

* * * * *